United States Patent [19]

Dickson

[11] Patent Number: 4,643,322

[45] Date of Patent: Feb. 17, 1987

[54] CAN FOR CONTAINING MATERIAL FOR CONSOLIDATION INTO WIDGETS AND METHOD OF USING THE SAME

[76] Inventor: James Dickson, P.O. Box 172, Stirling, N.J. 07980

[21] Appl. No.: 771,497

[22] Filed: Sep. 30, 1985

Related U.S. Application Data

[62] Division of Ser. No. 495,692, May 18, 1983, Pat. No. 4,545,955.

[51] Int. Cl.[4] ..... B65D 90/00

[52] U.S. Cl. ..... 220/15; 100/102; 100/299; 425/78; 425/DIg. 30

[58] Field of Search ..... 220/15; 100/299, 102; 425/78, DIG. 30

[56] References Cited

U.S. PATENT DOCUMENTS

| | | | |
|---|---|---|---|
| Re. 31,355 | 8/1983 | Rozmus | 419/49 |
| 4,142,888 | 3/1979 | Rozmus | 419/49 |
| 4,545,955 | 10/1985 | Dickson | 419/49 |
| 4,547,337 | 10/1985 | Rozmus | 419/49 |

*Primary Examiner*—Stephen J. Lechert, Jr.

*Attorney, Agent, or Firm*—Janine J. Weins; Michael J. Weins

[57] ABSTRACT

The present invention relates to a method of manufacturing widgets from components and/or particulate; and to a can for containing such components and/or particulate during the consolidation into widgets. The method of the present invention can be used to form widgets from metals, ceramics, plastics, polymers, and/or combinations thereof. The materials used to form the widgets can be in the form of particulate, pellets, shard, and/or ribbon. The method of the present invention can also be used to join widgets and/or to heal ingot cracks.

6 Claims, 5 Drawing Figures

CAN FOR CONTAINING MATERIAL FOR CONSOLIDATION INTO WIDGETS AND METHOD OF USING THE SAME

This application is a division of application Ser. No. 495,692, filed 5/18/83, now U.S. Pat. No. 4,545,955.

FIELD OF INVENTION

The present invention relates to a method of manufacturing widgets; and to a can for containing material during consolidation into widgets.

BACKGROUND ART

Widgets may be produced by the consolidation of material utilizing a variety of different techniques. A number of prior art techniques confine the material which is to be consolidated within a die, can or mold; and then subject the material to sufficient temperature and pressure to effect consolidation into the desired bulk object. If the material to be consolidated is of such a composition that it will react in a detrimental manner with the atmosphere, it may be necessary to hermetically seal the material in a container prior to consolidation. If the material is hermetically sealed without first evacuating the container absorbed gas and other contaminants will be sealed in the container. Therefore, when elevated temperature consolidation is preformed on materials that needed to be hermetically sealed within a container an opening is provided for removal of the entrapped gases and/or high vapor pressure contaminants prior to sealing and consolidation. Gaseous contaminants can be removed by heating the material, since heating will cause the partial pressure of the gaseous contaminants to increase and then flow through any opening in the container. If a reduction in entrapped gas pressure greater than that which can be achieved by heating is required, a vacuum can be applied to the container opening to assist in reduction of gas pressure.

One of the specific techniques utilized for elevated temperature consolidation is Hot Isostatic Pressing (HIP). Material that is to be consolidated by HIP is first contained in a can in which an opening is provided for removal of gaseous contaminants. Prior to consolidation the can is heated and/or subjected to a reduced pressure to remove entrapped gases and high vapor pressure contaminants. After removal of gaseous contaminants the can is hermetically sealed. The can containing the particulate is then subjected to sufficient temperature and isostatic pressure to effect the desired consolidation.

A variety of fluid die processes are also used to consolidate material into bulk shapes. As with the HIP can, the fluid die may be provided with a sealable opening for degassing.

One of the current processes utilizing fluid dies is Rapid Omnidirectional Compaction (ROC). Prior to ROC consolidation the material to be consolidated is contained within a fluid die. The fluid die is then heated to a temperature such that the mold material will respond as either a plastic compressible fluid, a plastic incompressible fluid or an elastomeric solid. The material contained within the fluid die yields under the consolidation pressure. ROC utilizes conventional forging equipment, such as hydraulic or mechanical presses to apply sufficient pressure to cause yield of the material and effect consolidation. One of the primary advantages of the ROC process is that the pressure is applied at a rapid rate and therefore only a short dwell time at elevated temperature is required. ROC is further described in U.S. Pat. Nos. 4,094,706, 4,233,720 and 4,142,888.

The above described prior art techniques require that the material which is to be consolidated be confined within a container; that gaseous contaminants be removed from the container; that the container then be sealed; and finally that the container be heated to the appropriate consolidation temperature. After the container is sealed the portion of the wall in the vicinity of the evacuation opening will have different deformation characteristics. This has meant that a truly uniform hydrostatic pressure could not be applied to the material since the container had inhomogeneities in the wall.

U.S. Pat. No. 4,104,782 teaches a method of providing a container for HIP which has a wall of uniform character. The container of the U.S. Pat. No. 4,104,782 is formed by applying a porous coating to a preform. The coating can be applied using any of a variety of conventional techniques including flame and plasma spraying. Since the coating of the U.S. Pat. No. 4,104,782 patent when applied is porous gas can flow through the coating when the coated preform is heated and/or subjected to a vacuum. The coating of the U.S. Pat. No. 4,104,782 patent is of such a composition and structure that the coating will densify and become non-porous and pressure-tight at elevated temperature. In this manner a container can be formed which has a wall of uniform character and does not require a separate operation of heating, evacuating and sealing prior to HIP.

U.S. Pat. No. 4,212,669, which is a continuation-in-part of the U.S. Pat. No. 4,104,782, teaches forming a two layer porous coating as shown in FIG. 1 on a preform that is to be consolidated by HIP. As with the coating of the U.S. Pat. No. 4,104,782, the coating of the U.S. Pat. No. 4,212,669 is initially pourous and at the conclusion of the degassing operation the coating becomes non-porous and pressure-tight. In the method of the U.S. Pat. No. 4,212,669 the inner layer 10 serves as a barrier layer to prevents diffusion of the coating into the material 12 that is to be consolidated. During the heating associated with degassing the outer layer 14 densifies and thereby becomes non-porous and pressure-tight prior to HIP as shown in FIG. 2.

Another method of forming a container having walls of uniform character is taught in U.S. Pat. No. 3,992,200. The container of the U.S. Pat. No. 3,992,200 is formed by applying a porous coating of uniform character to a preform. The coated preform of the U.S. Pat. No. 3,992,200 is then placed in a container which is filled with particulate. The particulate is composed of a first inert pressure transfer media and a secondary reactive pressure transfer media. To effect consolidation the coated preform is heated and pressure is applied to the coated preform through the pressure transfer media. During consolidation gaseous contaminants will flow from the porous preform through the porous coating and react with the secondary reactive pressure media. The U.S. Pat. No. 3,992,200 suggests using for the secondary pressure media particles of a reactive metal such as titanium, zirconium or hafnium. The coating of the U.S. Pat. No. 3,992,200 differs from the coating of the U.S. Pat. No. 4,104,782 and U.S. Pat. No. 4,212,669 patents in that the coating of the U.S. Pat. No. 3,992,200 patent does not lose its porous character.

An object of the present invention is to provide a multi-piece can for containment of material during consolidation, such can having walls which are initially semipermeable and prior to consolidation become nonpermeable.

An object of the present invention is to provide a continuous can for containment of material which is to be consolidated by the application of pressure at elevated temperature, such can having initially semipermeable walls which prior to consolidation seal by reaction or interaction to become nonpermeable.

Another object of the present invention is to provide a can for containment of cast ingots during the application of sufficient temperature and pressure to heal ingot cracks.

Another object of the present invention is the production of a seamless or multi-piece seamed can having walls made from flat powder.

These and other objects of the present invention will become apparent from the following description, figures and examples.

SUMMARY OF INVENTION

The present invention relates to a can for containing material that is to be consolidated into widgets. The can of the present invention may be formed in two or more pieces which when assembled provide a closed shaped cavity, on the the can of the present invention may have a continuous seamless wall. The wall of the can is made of a material which melts at a temperature higher than the temperature at which the particulate contained within the can is to be consolidated. The wall of the can of the present invention is deformable at the temperature at which the material is to be consolidated.

The can of the present invention is deformable at the consolidation temperature so that forces applied to the can during consolidation may be transferred to the material contained within the can.

In one embodiment continuous nonpermeable can segments are made by deposition onto a shaped form. The nonpermeable can segments and the material to be consolidated are placed in a vacuum to remove gaseous contaminants. While in a vacuum the can segments are assembled to form a closed cavity surrounding the material to be consolidated. The assembled nonpermeable can is then subjected to sufficient pressure and temperature to cause the material to be consolidated into the desired widget.

In one embodiment the wall of the can of the present invention is initially semipermeable, after degassing and prior to consolidation the wall becomes nonpermeable. Semipermeability permits gas and high vapor pressure contaminants entrapped within the can to pass through the wall of the can while the particulate is maintained within the can. Gases and high vapor pressure contaminants entrapped within the can are caused to pass through the wall of the can by heating the material contained within the can and/or by placing the can in a reduced pressure environment.

In one embodiment of the present invention the wall of the can is lamellar as shown in FIG. 3. The materials of which the lamellae are made are selected so that when the can is heated the material of which one of the lamella is made will soften and wick into the pores of the other lamella as shown in FIG. 4. In this manner the can wall will become nonpermeable and thereby the contents of the can will be hermetically sealed.

In another embodiment of the present invention the walls of the can have a lamellar structure, however, in this embodiment the lamellae are made of materials that react upon heating to form a nonpermeable wall.

The walls of the can of the present invention may be made using conventional deposition techniques including: arc plasma spraying, electroplating; and those techniques which utilize a solvent and/or other fluid carrier.

The can of the present invention may be placed within a die, a mold or a press, and while so contained subjected to sufficient pressure and temperature to effect consolidation into the desired widget.

Consolidation of material contained within the can of the present invention can be done using any of a variety of techniques including; closed die forging, extruding, ROC, HIP and stamping.

The can of the present invention may be used to contain any of a variety or combination of materials including; powder, ribbon, shard, flake and cast ingots.

The can of the present invention may be used to contain material of any of a variety of compositions and structure including; metals, polymers, ceramics, and/or a combinations.

The present invention is also directed to a method of consolidation. The method of the present invention includes the steps of first containing the material to be consolidated within a can having walls which are semipermeable. The can containing the material to be consolidated is then subjected to temperature for a time sufficient to remove gaseous contaminants which maybe entrapped within the can. During exposure to elevated temperature the materials of which the walls of the can are made are so selected as to cause the can walls to become nonpermeable. Finally the can and contents are subjected to sufficient pressure and temperature to effect consolidation into the desired widget.

BEST MODE FOR CARRYING THE INVENTION INTO PRACTICE

The present invention relates to a can for containing material which is to be consolidated into widgets. The can of the present invention may be a multi-piece can, or the can may be be a single piece can formed around a preform.

In one embodiment continuous nonpermeable can segments are made by deposition onto a shaped form. The nonpermeable can segments and the material to be consolidated are placed in a vacuum to remove gaseous contaminants. While in a vacuum the can segments are assembled to form a closed cavity surrounding the material to be consolidated. The assembled nonpermeable can is then subjected to sufficient pressure and temperature to cause the material to be consolidated into the desired widget. Preferred methods for applying the nonpermeable can segments to the shaped form are arc plasma spraying and D-gun deposition.

Figure 1:
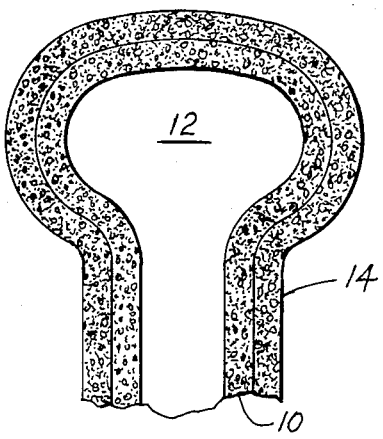
Fig. 1 PRIOR ART
FIG. 1 is a representation of the wall of a prior art can used to cotain particulate that is to be to consolidated by HIP.
Figure 2:
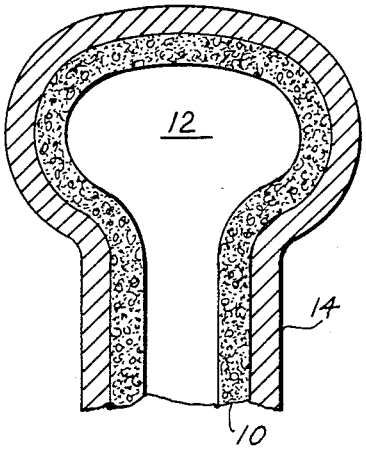
Fig. 2 PRIOR ART
FIG. 2 is a schematic representation of the wall of the prior art can shown in FIG. 1 after the wall has been heated to a temperature sufficient to cause the pores to seal.
Figure 3:
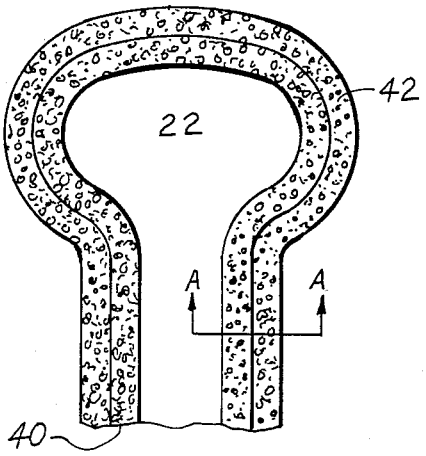
FIG. 3 is a schematic representation of a section of a wall of a can of the present invention.
Figure 4:
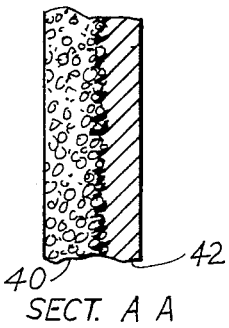
FIG. 4 is a schematic representation of the wall of the can shown in FIG. 3 after the wall has been exposed to sufficient temperature to cause the wall to become nonpermeable.

In one embodiment of the present invention the walls of the can are lamellar as shown in FIG. 3. The lamellar walls are initially semipermeable. In this embodiment the material of which the inner lamella 40 is made has a lower melting temperature than the outer lamella 42. When the can of this embodiment reaches a predetermined elevated temperature the material of the inner lamella 40 softens and wicks into the outer lamella 42 as shown in FIG. 4.

The outer lamella 42 preferably is made of a flat powder such as described in U.S. Pat. Nos. 4,290,808 and 4,381,943. Powders of this configuration are preferred because they have a high surface to volume ratio and therefore will readily bond; and because a flat powder will form a wall having tortuous porosity paths. These tortuous paths are will suited for the wick-sealing operation.

Recommended materials for forming the outer lamella of a can of this embodiment are Fe, Ni and Co base alloy which have sufficient metalloid content to permit them to readily be cast as amorphous or microcrystalline materials in accordance with the methods described in the U.S. Pat. No. 4,290,808 and the U.S. Pat. No. 4,381,943 patents. For the inner wicking lamella any of a variety of relatively low melting alloys based in Pb, Sn and Zn may be selected provided such alloys will not react in a detrimental manner with the material to be consolidated.

In another embodiment of the present invention the walls of the can have a lamellar structure. The lamellae are made of materials that although of different composition react at elevated temperature to form a nonpermeable wall. During the heating operation associated with degassing gaseous contaminants would initially flow through the semipermeable walls. Eventually the wall would be heated to such a temperature that the lamellae would interact to form a nonpermeable wall and thereby hermetically sealing the material to be consolidated.

Recommended materials for constructing the can of the present invention vary depending on the composition of the material to be consolidated. In the case in which iron base particulate is to be consolidated the inner lamella may be made of an iron-boron, iron-silicon, iron-carbon or similar eutectic alloy having a composition such that when the inner lamella wicks into the outer lamella an iron base alloy having a melting temperature higher than the melting temperature of the eutectic will be formed.

In the case in which aluminum alloy particulate is to be consolidated the inner lamella may be made of an aluminum eutectic or low melting alloy having a composition such that when the inner lamella wicks into the outer lamella an aluminum base alloy having a melting temperature higher than the melting temperature of the eutectic will be formed.

A recommended procedure for degassing and sealing the can of the present invention would involve a step heating. The can would first be heated to an appropriate temperature for degassing the contents of the can. The can would be held at this temperature for a time sufficient to reduce the gas pressure within the can to the desired level. If necessary a vacuum could be used to assist in the reduction of the gas pressure. After degassing the can would be heated to a temperature at which the inner lamella would either soften and flow into the pores of the outer lamella, or the inner lamella would react with the outer lamella to form a nonpermeable wall.

Figure 5:
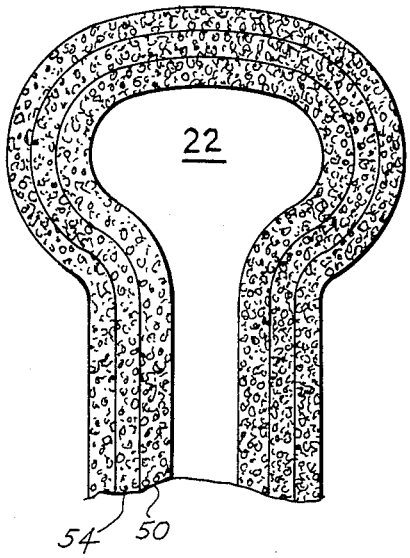
FIG. 5 is a schematic representation of another embodiment of the present invention in which a can having walls formed of three lamellae is utilized.

In another embodiment of the present invention shown in FIG. 5 a barrier lamella 50 is interposed between the material to be consolidated 22 and the inner lamella 54. An oxide or other non wetting layer may be used for this barrier lamella. The barrier lamella 50 serves to protect the material 22 which is to be consolidated from direct contact with the inner low melting temperature lamella 54, and may provide for easy stripping of the can from the consolidated widget.

The walls of a multi-piece can may be formed using either a negative or a positive pattern and applying to the pattern the material of the can wall utilizing any of a variety of conventional techniques. The pattern can be designed to compensate for shrinkage during consolidation using an interactive computer aided design (CAD) program and thereby using computer aided manufacturing (CAM) to produce near net shape widgets.

If the can of the present invention needs structural support the can may be contained within a mold or die. When using the semipermeable can of the present invention a semipermeable mold is preferred. Recommended materials for constructing a semipermeable mold are mixtures of core mix and ground soda lime glass frit.

The present invention also addresses a method of consolidating material. Using the method of the present invention a semi-permeable, deformable can containing the material to be consolidated is formed. The can has lamellar walls made of materials that upon heating will react and/or interact to form a continuous sealed wall. The can is subjected to temperature and/or reduced pressure for a time sufficient to reduce the gas level within the can to the desired limits and cause the can walls to seal. The can is then subjected to sufficient pressure and temperature to effect the consolidation of the material contained within the can.

While the novel features of this invention have been described in terms of preferred embodiments and particular applications, it will be appreciated that various omissions and substitutions in form and in detail to the can and the method may be made by those skilled in the art without departing from the spirit of the invention.

What I claim is:

1. A can for containment of material which is to be consolidated at a consolidation temperature, said can having lamellar walls wherein:

(a) said first permeable lamella having a first melting temperature surrounds the material which is to be consolidated;

(b) said second permeable lamella having a second melting temperature surrounds said first lamella;

(c) said first melting temperature is lower than said second melting temperature; and (d) said consolidation temperature is intermediate between said first melting temperature and said second melting temperature.

2. The can of claim 1 wherein said can is contained in a compressible deformable mold.

3. The can of claim 1 wherein said second lamella is made from a flat powder.

4. A can for containment of material which is to be consolidated at a consolidation temperature, said can having lamellar walls wherein:

(a) said first lamella bounding said cavities;

(b) said second lamella bounding said first lamella and not contiguous with said cavities; and (c) the material of said first lamella and said second lamella being selected so as to interact to form a nonpermeable can segment at said sealing temperature.

5. The can of claim 4 wherein said can is contained in a compressible deformable mold.

6. The can of claim 4 wherein said second lamella is made from a flat powder.

* * * * *